United States Patent [19]

Izraeli

[11] 4,118,971

[45] Oct. 10, 1978

[54] CRIMPING APPARATUS

[75] Inventor: Hyman Izraeli, West Caldwell, N.J.

[73] Assignee: David Teschner, Elizabeth, N.J.

[21] Appl. No.: 837,006

[22] Filed: Sep. 27, 1977

[51] Int. Cl.[2] ..... B21D 37/02

[52] U.S. Cl. ..... 72/410; 72/413; 72/472

[58] Field of Search ..... 72/409, 410, 413, 415, 72/416, 470, 472, 474

[56] References Cited

U.S. PATENT DOCUMENTS

| | | | |
|---|---|---|---|
| 1,321,208 | 11/1919 | Hinnershitz | 72/410 |
| 2,635,494 | 4/1953 | Rogoff | 72/409 |
| 2,712,253 | 7/1955 | Kontra | 72/409 |
| 3,212,317 | 10/1965 | Lynch | 72/416 |
| 3,314,135 | 4/1967 | Smith | 72/410 |
| 3,732,718 | 5/1973 | Barberio | 72/410 |

FOREIGN PATENT DOCUMENTS

| | | | |
|---|---|---|---|
| 845,334 | 8/1960 | United Kingdom | 72/410 |

*Primary Examiner*—C.W. Lanham
*Assistant Examiner*—Gene P. Crosby
*Attorney, Agent, or Firm*—David Teschner; Jesse Woldman

[57] ABSTRACT

Each of a pair of die nest members for a crimping tool comprises preferably four individual arms extending radially outwardly from a central longitudinal axis in a cruciform configuration permitting each arm to be selectively indexed into operative position in one jaw of the tool for disposition adjacent any one of the similarly indexable arms of the other die nest member in the other jaw of the tool to provide a selectively determinable pattern of mating die nest combinations. Each die nest member may be rotated about its transverse axis to insure that the desired die nest combination will be located at a position employing the most favorable mechanical advantage of the tool.

19 Claims, 15 Drawing Figures

CRIMPING APPARATUS

FIELD OF THE INVENTION

The invention is directed to the field of crimping tools for electrical connectors and the like.

DESCRIPTION OF THE PRIOR ART

Prior art crimping tools for electrical connectors or the like are well known in the art and generally comprise certain forms or variations of plier-like tools in which a particular die nest combination has been preformed directly in the jaw members of the tool. These devices, although generally suitable for limited applications, have the drawback of providing a relatively limited number of unalterable die nest combinations. To overcome this limitation other devices have been designed to provide a plurality of die nests in the working jaw members of the tool and are exemplified in U.S. Pat. No. 2,774,269 issued Dec. 18, 1956 to H. W. Demler et al; and U.S. Pat. No. 2,900,954 issued Aug. 25, 1959 to W. M. Werner. Both the Demler and Werner devices comprise coplanar die nest members. The Demler device, however, is limited to a single fixed set of die nest configurations located at fixed positions from the pivot point of the jaws, while the Werner device features a pair of die plates each of which is independently rotatable about a single pivot point to bring the two halves of the desired die nest combination into mating juxtaposition. Although the Werner device permits selective indexing of the die nests to permit their placement at a preselected position, only one such die nest combination may be, at any one time, deployed in an operative position. A rotatable die member having a single die nest located on each of four arms disposed in a cruciform pattern is disclosed in U.S. Pat. No. 2,952,174 issued Sept. 13, 1960 to W. F. Broske. This device, however, employs the die nests solely as a backup support or anvil for a cam driven indentor which thereby produces only a single type of crimp configuration.

SUMMARY OF THE INVENTION

The invention overcomes the limitations noted above with respect to prior art devices by providing a multi-nest crimping tool which is simpler, more convenient and more versatile than such prior art devices. In a preferred embodiment the tool comprises a pair of jaw members, each of which is arranged to receive one of a pair of die nest members each comprising preferably four elongate arms containing preferably two or more die nests each and arranged in a cruciform pattern in which each of the arms extends radially outwardly from the central longitudinal axis of the die nest member. Each die nest member may thus be indexed or oriented to position any one of the arms in opposed mating relationship with any one of the arms of the other die nest member. Each die nest member may be rotated within the plane of its longitudinal axis in end-to-end manner so that certain preselected die nest combinations may be disposed as close as possible to the fulcrum or pivot of the tool jaws. The various die nests provided on each of the arms of the die nest members may be preselectively positioned and configured so as to provide both mating and matching die nest combinations comprising either similar or dissimilar die halves simply by indexing and manipulating each of the die nest members in accordance with a predetermined indexing system. Identifying indicia may be placed at either or both ends of each of the die nest members and within each of the die nest recesses to provide the user with a readily available means for presetting the die nest members in the required configuration. Locking means which may include a slidable spring member coupled to the end of each of the jaw members may serve the dual function of retaining each of the die members in their respective jaw members while shielding a portion of the die nests which are farthest from the fulcrum or pivot of the tool to prevent the inadvertent use thereof, thus directing the user to the die nest configurations closest to the fulcrum or pivot point of the tool. It is therefore an object of this invention to provide an improved crimping tool.

It is another object of this invention to provide a multi-nest crimping tool.

It is a further object of this invention to provide a selectable multi-nest crimping tool.

It is yet another object of this invention to provide a convenient indexing system for a multi-nest crimping tool.

It is yet a further object of this invention to increase the die nest capacity of a multi-nest crimping tool.

It is still another object of this invention to provide a crimping tool having selectively indexable and rotatable die nest members.

It is yet a further object of this invention to provide a multi-nest crimping tool having manually selectable die nest combinations.

It is still another object of this invention to provide a multi-nest crimping tool which combines the advantages of die nest selectability and prepositioning for improved mechanical advantage.

Other objects and features will be pointed out in the following description and claims and illustrated in the accompanying drawings, which disclose, by way of example, the principle of the invention, and the best modes contemplated for carrying it out.

BRIEF DESCRIPTION OF THE DRAWINGS

In the Drawings.

Similar elements are given similar reference characters in each of the respective drawings.

DESCRIPTION OF THE PREFERRED EMBODIMENTS

Figure 3:
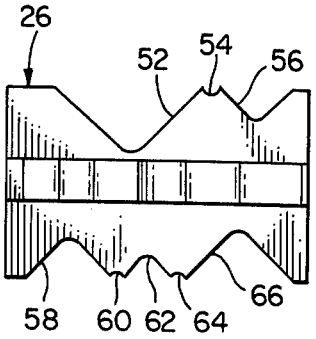
FIG. 3 is a side view of a die nest member constructed in accordance with the concepts of the invention.
Figure 4:
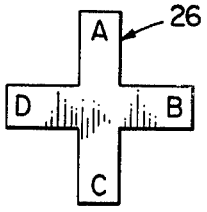
FIG. 4 is an end view of the device of FIG. 3.
Figure 5:
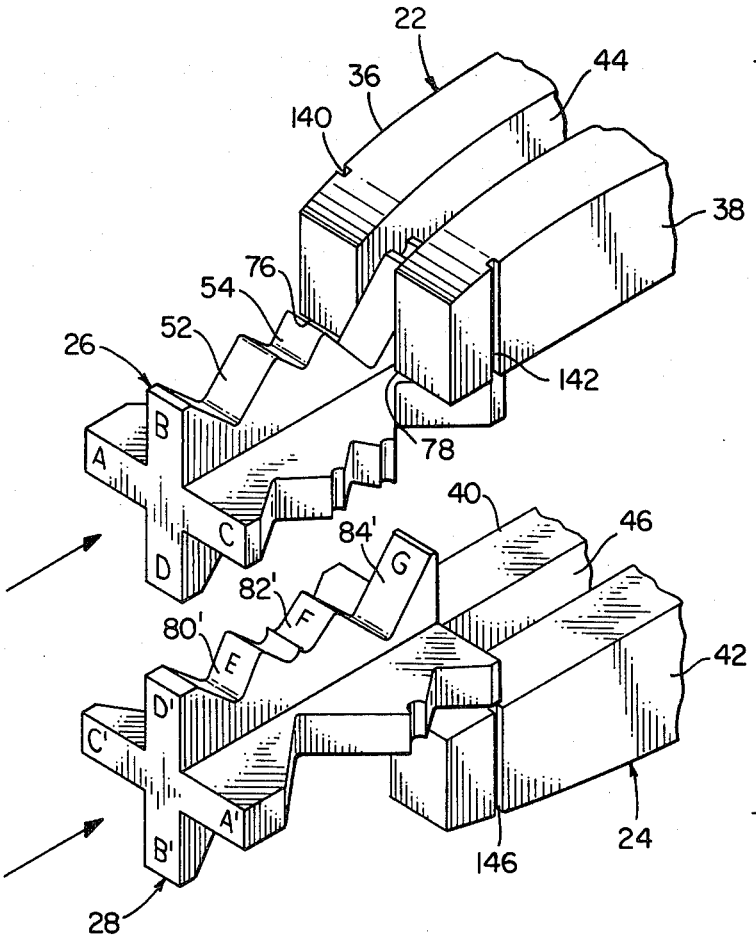
FIG. 5 is a fragmentary perspective view showing the die nest members of the device of FIG. 1 partially engaged within the jaw members of the device of FIG. 1.
Figure 6:
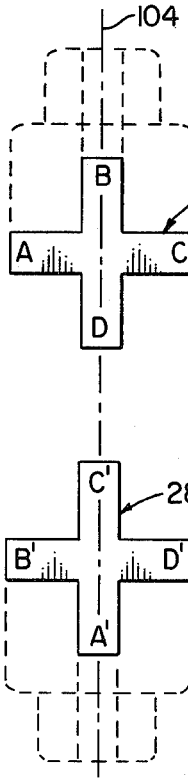
FIG. 6 is an end view of a pair of die nest members constructed in accordance with the concepts of the invention.
Figure 7:
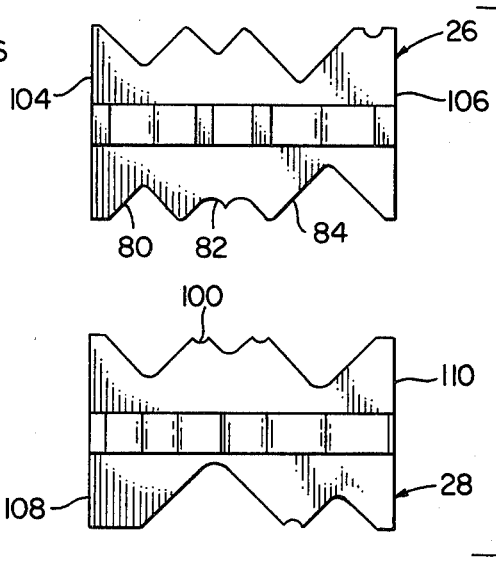
FIG. 7 is a side view of the elements shown in FIG. 6.
Figure 9:
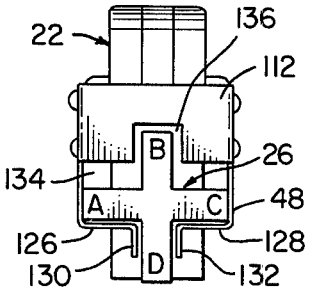
FIG. 9 is an end view, partly in section, showing the means of FIG. 8 attached to a jaw member of a crimping tool constructed in accordance with the concepts of the invention.
Figure 10:
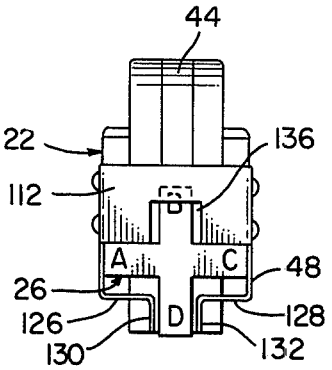
FIG. 10 is an end view, partly in section, showing the means of FIG. 8 deployed in a locking position on the jaw member of a crimping tool constructed in accordance with the concepts of the invention.
Figure 15:
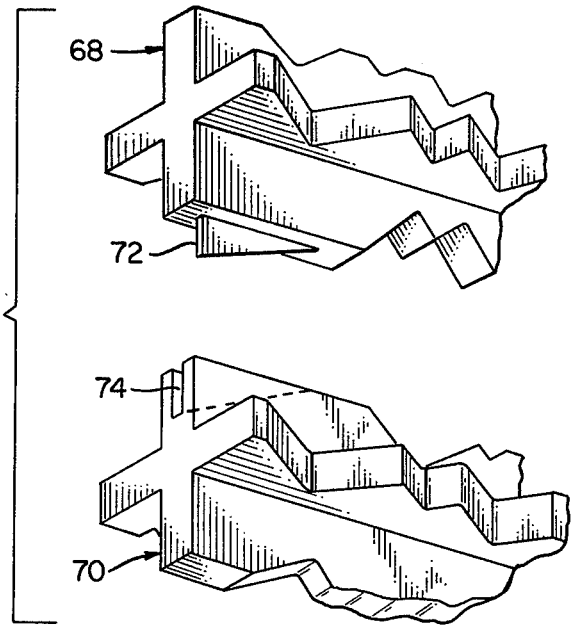
FIG. 15 is a fragmentary perspective view showing a further embodiment of a pair of die nest members constructed in accordance with the concepts of the invention.
Figure 11:
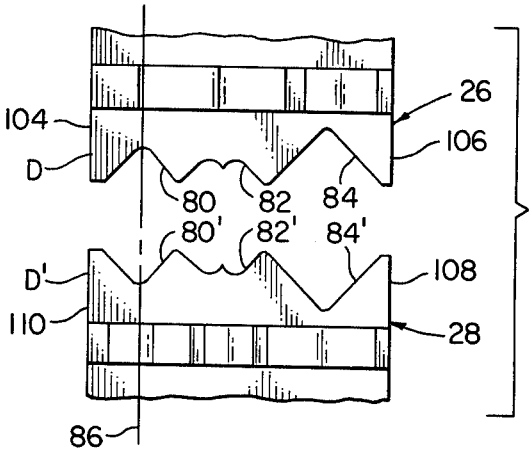
FIG. 11 is a fragmentary side view showing a particular orientation of a pair of die nest members constructed in accordance with the concepts of the invention.
Figure 12:
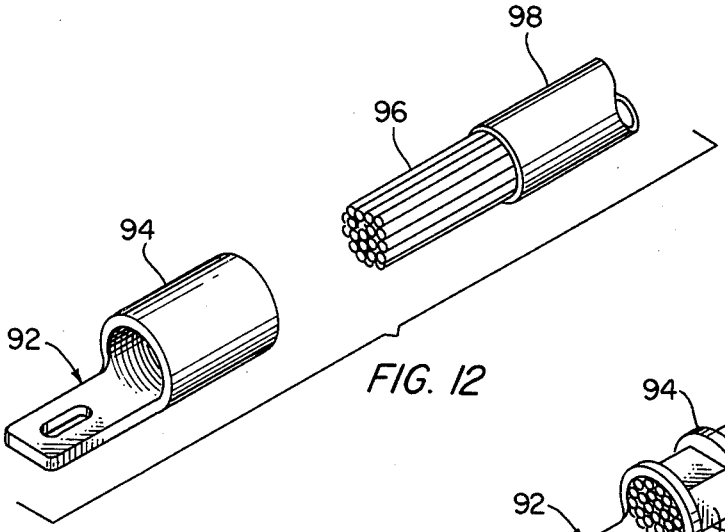
FIG. 12 is an exploded fragmentary perspective view showing a conductor end and a receiving terminal preparatory to crimping in the device of FIG. 1.
Figure 13:
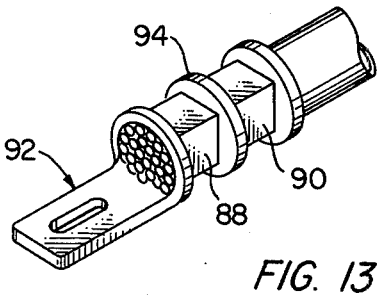
FIG. 13 is a fragmentary perspective view showing a crimped connection accomplished by means of the invention shown in FIG. 1.
Figure 14:
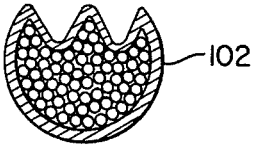
FIG. 14 is a sectional view of a further crimp configuration performed by the device of FIG. 1.

Turning now to FIGS. 1 through 11 there is shown a crimping tool nose portion 20 (FIG. 1) constructed in accordance with the concepts of the invention. The nose portion 20 comprises a pair of jaw members 22 and 24 in which are respectively disposed a corresponding pair of die nest members 26 and 28. The jaw members 22 and 24 are movably joined together by a link member 30 which is fastened to each jaw member by way of fasteners 32 and 34 permitting each jaw member 22 and 24 to pivot thereabout. The details of such pivoting construction are well known in the art and will therefore not be described further. However, it should be noted that the fasteners 32 and 34 each provide a fulcrum for its corresponding jaw member 22 and 24, and that the jaw members 22 and 24 are thus joined together at their respective fulcrums. Each of the jaw members 22 and 24 includes a pair of spaced parallel sidewalls, as shown in detail in FIG. 5, the numerals 36 and 38 denoting the sidewalls associated with jaw member 22 and the numerals 40 and 42 denoting the sidewalls associated with the jaw member 24. Intermediate each pair of sidewalls 36 and 38, and 40 and 42, is a respective slotted opening 44 and 46 of generally uniform width throughout its length. As may be seen in greater detail in FIG. 5, each die nest member 26 and 28 comprises four elongate arms, the four arms of die nest member 26 being denoted by the letters A, B, C, and D, and the four arms of die nest 28 being denoted by the letters A′, B′, C′, and D′. The arms of each die nest member 26 and 28 extend radially outwardly from a central longitudinal axis and lie within mutually perpendicular planes, in a general cruciform pattern. It should be appreciated that although a preferred construction is shown in FIG. 5 in which each die nest member 26, 28, is of unitary construction wherein the members are each formed from a single block of material, a satisfactory alternative arrangement may include separate arms joined to a centrally disposed support (not shown) so that, for example, the arms A,B,C, and D are suitably keyed or grooved for mating engagement with a central elongate key or strut. Such construction would permit the removal and replacement or any one or more of the arms A,B,C, and D and, in like manner, the arms A′, B′, C′, and D′, where necessary or desirable, such arrangement being in accordance with the concepts of the invention and within the concepts herein disclosed. Located adjacent the free end of each jaw member 22 and 24 is a respective locking means 48, 50 which is preferably slidably coupled to its respective jaw members 22 and 24 and which provides both a die nest member restraint and a shield means, as will be described in greater detail hereafter. The reference letters, A,B,C,D, and A′, B′, C′, D′ which have been noted above as denoting the respective arms of the die nest members 26 and 28 may be conveniently employed as identification means for assisting the user in orienting and indexing the die nest members 26 and 28 for proper die nest mating. In this regard it should be noted that each arm of each die nest member comprises preferably a plurality of recessed areas or die nests. For example, one of the die nests members 26 is shown in FIG. 3 and the visible die nests include nests 52, 54 and 56 associated with arm B. The particular die nest configurations evident in the drawings are shown for the sake of illustration only and are not intended as a limitation or restriction with regard to the scope of the invention. Accordingly, any suitable die configuration may be employed in a similar manner within the concepts herein disclosed. For example, although the die nest configurations shown in FIGS. 1 through 11 are employed principally for crimping purposes, an arrangement such as that shown in FIG. 15 may be readily provided, where necessary or desirable. FIG. 15 shows a pair of die nest members 68 and 70 each of which is essentially similar to members 26 and 28 described above. However, one of the die stations in die nest member 68 includes a cutter blade 72 which is arranged to mate with a blade receiving slot 74 in die nest member 70 so that, as the members 68 and 70 are brought together, the elements 72 and 74 may be employed to sever a cable inserted therebetween. The guillotine configuration of the blade 72 shown in FIG. 15 may be varied or modified to include curved, pointed, serrated, or other like suitable edge configurations, where necessary or desirable. As further illustrated in FIG. 5, the die nest member 26 is indexed to expose its arm D with arm B being located within the slotted opening 44 in jaw member 22. Opposingly disposed arms A and C are thus brought to bear against shoulder portions 76 and 78 defining the undersurfaces of sidewalls 36 and 38 of jaw member 22. In a similar manner, the die nest member 28 is indexed to expose its arm D′ for operative mating relationship with the arm D of die nest member 26. It should be further noted that each die station may be provided with identifying indicia such as indicated by the letters E, F, and G in die nests 80, 82, and 84, respectively, of the die nest member 28, as shown in FIG. 5. Each of the die nest members 26 and 28 may be so constructed as to provide any suitable arrangement of die nest contours and locations on each of the arms thereof. For example, arm A of die nest member 26 may have a die nest configuration identical to arm A′ of die nest member 28, with a similar correspondence between arms B and B′, C and C′, and D and D′. This configuration is exemplified in FIG. 11 where the die nest members 26 and 28 are shown oriented and indexed so that the arm D is in opposed mating relationship with the arm D′ to provide a symmetrical arrangement of corresponding die nest halves, that is, the die nest identified by the numerals 80, 80′ are essentially identical to one another and are bisected by a common axis 86 when the die nest members 26 and 28 are properly seated within the jaw members 22 and 24. For the purposes of illustration the die nests 80, 80′ are shown as substantially V-shaped recesses which, when brought together, will provide a substantially square crimp configuration as shown at 88 and 90 in FIG. 13. This is accomplished by: providing a terminal 92 (FIG. 12) having a suitable barrel portion 94 arranged to receive the bared end 96 of a conductor 98; inserting the end 96 of the conductor 98 into the barrel 94; placing the assembly between the die nest members 26 and 28 which have been suitably assembled to the respective jaw members 22 and 24; and closing the jaw members 22 and 24 so that the barrel 94 is subjected to a compressive force directionally governed by the contours of the die nests 80. The die nests 80 are designed for a specific barrel and conductor size or range of sizes which may be made known to the user in any convenient manner such as by the aid of a chart, table or other like instructional device (not shown) which may accompany the die members 26 and 28. Each of the arms A, B, C, and D may, of course, be provided with a differently configured die nest so that, for example, if each arm is provided with a series of three different die nest stations, a single die nest member such as 26 may then contain a total of twelve different die nest configurations each of which has a counterpart in the die nest configurations of die nest member 28. Furthermore, by suitably designing the die nest recesses various combinations which may include mating pairs consisting of V-shaped die nests operatively aligned with an indentor nest such as 82 in FIG. 11 may be provided by properly indexing the die nest members. For example, as shown shown in FIGS. 6 and 7, the arm D of die nest member 26 is shown indexed in opposed operative relationship with the arm C' of die nest member 28, the die nests of arm C' having been selectively arranged and configured so as to provide an indentor nest 100 in mating relationship with the V-shaped die nest 80 of arm D of the die nest member 26. The resulting crimp configuration produced by these two nests is shown generally at 102 in FIG. 14. In like manner other suitable mating die nest arrangements may be provided at selected locations in accordance with a predetermined indexing pattern. The slotted openings 44 and 46 in the respective jaw members 22 and 24 are selectively dimensioned to accept any one of the arms of the die nest members 26 and 28 preferably in close sliding relationship to permit proper alignment between the two die nest members 26 and 28 during the crimping operation. The particular arms which are positioned in opposed operative relationship will thus lie along a common plane as indicated, for example, by a plane edge 104 shown in FIG. 6. Each of the die members 22 and 26 may also be turned end-to-end about a transverse axis perpendicular to its respective longitudinal axis to provide additional die nest combinations. For example, in the arrangement shown in FIG. 7 the die nest member 26 comprises a first end 104 and a second end 106 while member 28 comprises a first end 108 and a second end 110. The die nest members 26 and 28 may be seated in the jaw members 22 and 24 either in a first relationship such as shown in FIG. 7 wherein the ends 104, 108 are in adjacent disposition and are located towards the outboard or free end of the respective jaw members 22 and 24, or in a second relationship where either end 104 or 108 is reversed in position so that end 104 is disposed adjacent end 110 and end 106 is disposed adjacent end 108, with ends 104 and 110 being located towards the outboard or free end of the respective jaw members 22 and 24. Additionally, either end of each of the die nest members 26 and 28 may be reversed so that either one of their ends may be located towards the pivot or fulcrum of the jaw members 22 and 24. The die nest members 26 and 28 may, of course, be so designed as to provide die nest combinations arranged for mating relationship in any of the orientations described above. It has also been found advantageous to selectively position the various die nests along each arm of each die nest member 26 and 28 so that those die nest combinations requiring greater operative forces are located adjacent either end of the respective die nest members in order to utilize the best available mechanical advantage of the jaw members 22 and 24. To illustrate this point, in FIG. 11 the largest die nest combination of arms D and D' of the respective die nest members 26 and 28 is identified by the reference numerals 84, 84', the next largest by the reference numerals 80, 80', and the smallest by the reference numerals 82, 82'. The die nest combinations 80, 80' and 84, 84' are located adjacent the respective ends of the die nest members 26 and 28 while the smallest die nest combination 82, 82' is located inboard of the ends. Accordingly, where the die nest combination 84, 84' is to be employed for a particular crimping operation, the die nest members 26 and 28 may be oriented in the respective jaw members 22 and 24 so that the ends 106 and 108 are located closest to the fulcrum or pivots of the jaw members 22 and 24. Both die nest members 26 and 28 may be similarly reversed and repositioned when the die nest combination 80, 80' is to be so employed. The centrally located die nest combination 82, 82' is shown in FIG. 11 as relatively small in comparison with the adjacent die nest combinations 80, 80' and 84, 84' and, under normal circumstances, would require the application of significantly less compressive force to complete the crimp operation. Thus, the die nest members 26 and 28 may be oriented in the jaw members 22 and 24 with the ends 104 and 110 located either close to or remote from the fulcrum or pivot with substantially equal effectiveness when employing the die nest combination 82, 82'. In any case, the die nest members 26 and 28 may include a chart, table, markings, or other suitable instructions or indicia directing the user to the proper or preferred orientation of the die nest members 26 and 28 for each designated die nest combination.

Figure 1:
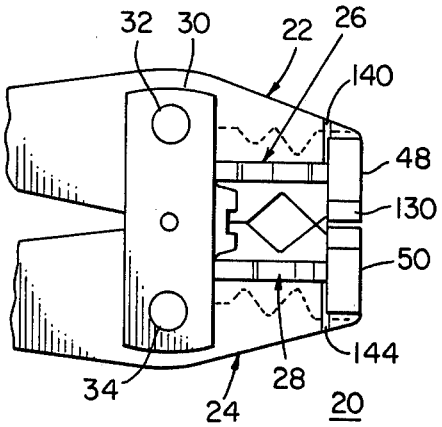
FIG. 1 is a fragmentary plan view showing a portion of a crimping tool constructed in accordance with the concepts of the invention.
Figure 2:
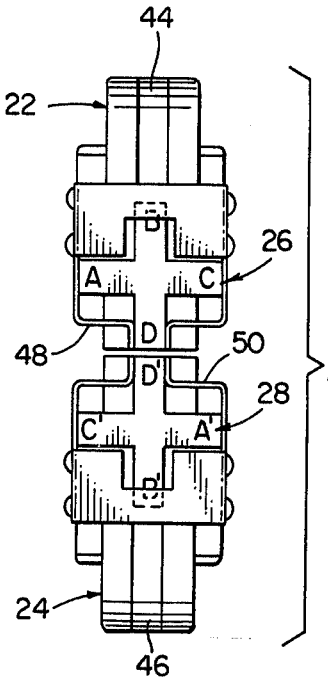
FIG. 2 is a front elevational view, partly in section, of the device of FIG. 1.
Figure 8:
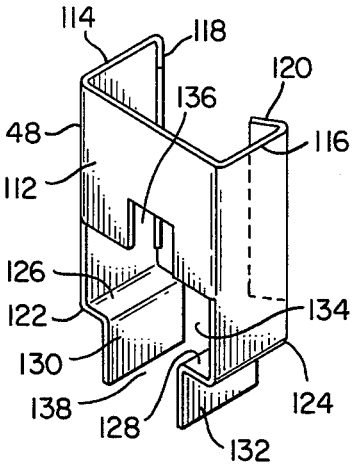
FIG. 8 is a perspective view of a locking means constructed in accordance with the concepts of the invention.

Referring now to FIGS. 8, 9, and 10, the locking means 48 and 50 (FIG. 3) are preferably similarly constructed and, accordingly, the details of one of such means 48 will be described although it should be understood that the description is equally applicable to both. In the preferred embodiment shown in FIG. 8, the locking means 48 comprises a generally U-shaped member having a base portion 112 from which extend leg portions 114 and 116 which terminate respectively in inturned finger portions 118 and 120. The leg portions 114 and 116 are further folded at one edge 122 and 124, respectively, to provide inwardly directed shoulder portions 126 and 128 from which extend, respectively, spaced parallel skirt portions 130 and 132. Intermediate the base portion 112 and the shoulder portions 126 and 128 is a first opening 134 extending between the leg portions 114 and 116 and communicating with a smaller second opening 136 aligned generally with the passageway 138 defined by the opposed inner surfaces of the skirt portions 130 and 132. The finger portions 118 and 120 are arranged to engage transverse slots 140 and 142 located adjacent the respective free ends of the sidewalls 36 and 38 of jaw member 22. Similar slots 144 (FIG. 1) and 146 (FIG. 5) are provided in the sidewalls 40 and 42 of jaw member 24 to receive the inturned finger portions of the locking means 50 which, as noted above, correspond to the finger portions 118 and 120 of locking means 48. The locking means 48 and 50 are placed over the free ends of the jaw members 22 and 24, substantially as shown in FIG. 1, prior to the insertion therein of the die nest members 26 and 28 and are positioned substantially as shown in FIG. 9 which, for the sake of convenience has been limited to the illustration of locking means 48 although applicable to both means 48 and 50. After the die nest members 26 and 28 are inserted fully into their respective jaw members 22 and 24, the locking means 48 and 50 are slidingly moved to the position shown in FIG. 10 wherein, for example, the base portion 112 of the locking means 48 partially covers the arm of the die member 26 which extends within the slotted opening 44 thereby restraining the removal of die member 26. Additionally, the skirt portions 130 and 132 operate to shield a given portion of the extending operative arm of die nest member 26 adjacent the free end of the associated jaw member 22. Thus, the die nest combination which is farthest from the pivot or fulcrum of the jaw members 22 and 24 is effectively rendered unavailable for use. In the event the user wishes to employ the die nest combination which is so shielded, he will simply reverse the orientation of both die nest members 26 and 28 in the jaw members 22 and 24 so that the previously shielded die nest combination is located in an unshielded area close to the fulcrum or pivot of the jaw members 22 and 24 for improved mechanical advantage. It should also be noted that the particular construction of the locking means 48 and 50 prevents their accidental removal from the jaw members 22 and 24 while the die nest members 26 and 28 are in place since the shoulder portions 126 and 128 are caused to abut the underside of the laterally extending arms of the associated die nest member, thereby preventing its further movement, generally as shown in FIG. 9, in the event the particular locking means such as 48 is moved upwardly, as viewed in FIG. 9. If the locking means such as 48 is moved in the opposite direction or downwardly, as viewed in FIG. 10, the bottom edge of the base portion 112 is caused to abut the adjacent surfaces of the laterally extending arms of the associated die nest member such as 26 in FIG. 10, thus preventing further movement of the locking means in such downward direction. However, if the particular die nest member is removed from its associated jaw member, the locking means such as 48 may be freely moved downwardly, as viewed in FIG. 10, and released from its associated jaw member. It should also be noted that, in the preferred embodiment, the locking means 48, 50 is formed preferably from sheet stock and the finger portions 118 and 130 inturned sufficiently to resiliently grasp the slotted openings 140, 142 and 144, 146 in the respective jaw members 22 and 24, thus providing a sliding assembly therebetween.

It will, of course, be readily apparent to those skilled in the art that although the die nest members 26 and 28 are each shown as comprising four arms in the preferred embodiment, a satisfactory arrangement which may include less or more than such number (not shown) may be employed in similar fashion without departing from the spirit of the invention and within the concepts herein disclosed.

I claim:

1. Apparatus for crimping ferrules of various sizes onto a conductor comprising: tool means having a pair of opposingly disposed jaw members joined to one another at a fulcrum, each jaw member being defined by spaced parallel sidewalls defining an elongate slotted opening therebetween, said jaw members being movable towards and away from one another; a pair of elongate die nest members, one for each of said jaw members, each of said die nest members comprising four arms extending radially outwardly from the central longitudinal axis of said die nest member along mutually perpendicular planes in cruciform relationship, each of said arms carrying at least one die nest, a first one of said arms of each of said die members being removably located in a respective one of said slotted openings in said jaw members, the arm opposite said first arm of one of said die nest members being arranged in coplanar opposed mating relationship with a similarly disposed arm of the other of said die nest members in the other of said jaw members; and locking means engageable with each of said jaw members for removably locking each of said die nest members to a respective one of said jaw members.

2. Apparatus as defined in claim 1 wherein said sidewalls of said jaw members are each provided with shoulder portions arranged to abuttingly receive second and third coplanar arms of a respective one of said die nest members to provide support means therefor.

3. Apparatus as defined in claim 1 wherein each arm carries at least two die nests.

4. Apparatus as defined in claim 1 wherein each arm of said die nest members is provided with first identification means for establishing a particular orientation between the said arms of one of said die nest members and the said arms of the other of said die nest members.

5. Apparatus as defined in claim 4 wherein each of said die nests is provided with identification means.

6. Apparatus as defined in claim 1 wherein at least one of said arms of one of said die nest members has a die nest configuration substantially identical to the die nest configuration of a corresponding one of said arms of the other of said die nest members.

7. Apparatus as defined in claim 1 wherein each of said die nests carried by a particular one of said arms of one of said die nest members has a mating counterpart carried by a particular one of said arms of the other of said die nest members.

8. Apparatus as defined in claim 1 wherein both of said die nest members are substantially identical.

9. Apparatus as defined in claim 1 wherein each arm of each of said die nest members is positionable in said slotted opening in either of said jaw members.

10. Apparatus as defined in claim 1 wherein each of said die nest members comprises a first end and a second end, each of said die nest members being selectively positionable in a respective one of said jaw members in either one of two positions including a first position wherein said first end is located inwardly of the free end of said jaw member adjacent said fulcrum, and a second position wherein said second end is located inwardly of the free end of said jaw member adjacent said fulcrum.

11. Apparatus as defined in claim 10 wherein particular ones of said die nests are selectively located on each of said arms with respect to said first and said second ends of each of said die nest members.

12. Apparatus as defined in claim 11 wherein those of said die nests requiring a greater operating force than other die nests on a common one of said arms are located adjacent either one of said first and said second ends for disposition generally adjacent said fulcrum.

13. Apparatus as defined in claim 1 wherein said locking means comprises a first locking member and a second locking member, one for each of said jaw members, each of said first and said second locking members being movably coupled to a respective one of said jaw members.

14. Apparatus as defined in claim 13 wherein each of said first and said second locking members is coupled to the free end of a respective one of said jaw members.

15. Apparatus as defined in claim 14 wherein each of said first and said second locking members comprises a first means for restraining the removal of a respective die nest member from its associated jaw member.

16. Apparatus as defined in claim 15 wherein each of said first and said second locking members comprises a second means arranged to at least partially shield a selective one of said die nests.

17. Apparatus as defined in claim 13 wherein each of said first and said second locking members is slidably coupled to a respective one of said jaw members.

18. Apparatus as defined in claim 17 wherein each of said first and said second locking members comprises a generally U-shaped member having a base portion and extending leg portions, each of said leg portions terminating in an inturned finger portion, each of said jaw members having spaced parallel grooved portions adjacent its free end for receiving said inturned finger portions.

19. Apparatus as defined in claim 18 wherein said base portion of each of said first and said second locking members comprises a notched portion providing a restrictive opening, each of said locking members being movable from a first position wherein said notched portion overlaps the adjacent end of an associated one of said die nest members and comprises said first means, to a second position wherein said notched portion fully exposes the adjacent end of said associated one of said die nest members to permit its removal from said jaw member.

* * * * *

UNITED STATES PATENT AND TRADEMARK OFFICE

CERTIFICATE OF CORRECTION

PATENT NO. : 4,118,971

DATED : October 10, 1978

INVENTOR(S) : Hyman Izraeli

It is certified that error appears in the above-identified patent and that said Letters Patent are hereby corrected as shown below:

Column 1, line 5, after Assignee: "David Teschner" should be -- Thomas & Betts Corporation --.

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*